United States Patent [19]

Fajner et al.

[11] Patent Number: 4,459,572

[45] Date of Patent: Jul. 10, 1984

[54] CIRCUIT BREAKER WITH IMPROVED LATCH TRIP MECHANISM

[75] Inventors: Michael J. Fajner, Bayside; Peter J. Theisen, West Bend; Marian M. Rzepecki, Brown Deer, all of Wis.

[73] Assignee: Eaton Corporation, Cleveland, Ohio

[21] Appl. No.: 416,784

[22] Filed: Sep. 10, 1982

[51] Int. Cl.[3] ..... H01H 73/00; H01H 73/48

[52] U.S. Cl. ..... 335/16; 335/23

[58] Field of Search ..... 335/23, 35, 16, 21; 200/144 AP

[56] References Cited

U.S. PATENT DOCUMENTS

| | | | |
|---|---|---|---|
| 2,502,537 | 4/1950 | Speck | 335/23 |
| 3,953,812 | 4/1976 | Heft et al. | 335/23 |

FOREIGN PATENT DOCUMENTS

| | | | |
|---|---|---|---|
| 3028900 | 2/1982 | Fed. Rep. of Germany | 335/23 |
| 0915120 | 3/1982 | U.S.S.R. | 335/23 |

*Primary Examiner*—J. D. Miller
*Assistant Examiner*—George Andrews
*Attorney, Agent, or Firm*—C. H. Grace; L. G. Vande Zande

[57] ABSTRACT

A circuit breaker having a pivotal movable contact arm (6) operated between open and closed positions with a stationary contact (14*c*) by an overcenter drive spring (8) in response to pivotal movement of a manual operating handle (4). A latch lever (10) is provided to locate the other end of the drive spring (8) and is releasable upon overload currents to carry the point of connection (10*d*) of the drive spring and latch lever essentially downward in line with the line of action of the drive spring to quickly reduce its force and stored energy, thereby quickly reducing the contact pressure provided thereby and enabling constriction and/or repulsion forces to separate the contacts (6*c*,14*c*). A further amount of movement of the latch lever (10) carries the point of connection (10*d*) of the drive spring and latch lever across the pivot plane of the movable contact arm (6) to separate the contacts. The latch lever (10) is released by a pivotally supported latch arm (12). A bimetal current sensing member (20) is supported upon a high resistance terminal (18) to concentrate heat in the bimetal member (20) adjacent its fixed end, thereby causing greater deflection at the free end of the bimetal. An extension (18*b*) of the terminal (18) projects inwardly of the breaker and it is disposed adjacent an arc extinguishing structure (26) to provide a bypass path for high overload current existing in the arc to protect the bimetal from damage.

13 Claims, 2 Drawing Figures

CIRCUIT BREAKER WITH IMPROVED LATCH TRIP MECHANISM

BACKGROUND OF THE INVENTION

This invention relates to circuit breakers of the molded case, narrow width type such as is shown and described in U.S. Pat. No. 3081386 to M. F. Koenig et al dated Mar. 12, 1963 and owned by mesne assignments by the assignee herein. Circuit breakers of this type are normally utilized in residential and commercial applications up to 240 volts.

In circuit breakers of the aforementioned type, a movable contact is driven between open and closed positions with a stationary contact by an overcenter drive spring connected between the movable contact and a latch lever. An operating lever is pivotally moved to carry a pivot end of the movable contact back and forth across the center, or line of action, of the drive spring to effect contact separation in a manual mode. The latch lever is released in response to overload currents to carry the drive spring across the plane of the pivoted movable contact to effect contact separation in an automatic mode. The force provided by the drive spring also establishes contact pressure for the breaker contacts. In prior art circuit breakers of this type, the latch lever is pivoted such that its motion will carry the spring quickly overcenter of the plane of the movable contact while minimizing any foreshortening of the working length of this spring, thereby to quickly separate the breaker contacts while the contact pressure remains substantially constant prior to contact separation. Such operation follows recognized good electrical circuit switching techniques for primary switching devices.

It has been found, however, that under high currents such as high short circuit conditions, forces associated with the high currents exert an opening force on the movable contact which counteracts the contact pressure and tends to cause the contacts to separate in advance of the point at which the released latch lever carries the drive spring across the plane of the movable contact. The magnitude of this opening force is proportional to the current and determines the rate at which the contact force is reduced and ultimately overcome to effect contact separation. Early and rapid contact separation is desirable in high current interruption and inasmuch as circuit breakers are not primary switching devices subjected to high lifetime operations, it is not essential that contact life requirements of a circuit breaker meet those of primary switching devices. As mentioned above, primary switching devices maintain the contact pressure substantially constant during initial switch mechanism movement and abruptly reduce this pressure at the point at which the mechanism effects contact separation. For circuit breakers, however, reduction of the contact pressure early in the movement of the operating mechanism enables the forces associated with high currents to quickly overcome the contact pressure and thereby advantageously effect early and rapid separation of the contacts.

Circuit breakers of the aforementioned type utilize bimetallic elements to sense low magnitude overload currents whereby such currents generate heat in the bimetal which cause it to deflect uniformly along its length to operate a latch lever release system. Critical attention to the selection of the particular composition of the bimetal element is necessary to achieve the required travel for releasing the latch system within the confinements of the available space within the breaker. However, highly sensitive bimetal elements are susceptible to damage when subjected to high currents whereby the bimetal may take a "set" and not return to its original position upon removal of the current.

SUMMARY OF THE INVENTION

The invention described herein provides a circuit breaker of the type wherein a pivotally supported movable contact is driven into and out of engagement with a stationary contact by an overcenter drive spring in response to operator movement which carries the line of action of the drive spring across the plane of the movable contact member. One end of the drive spring is connected to the movable contact member and the opposite end thereof is connected to a latch lever which is releasably latched by overcurrent responsive means. The latch lever is pivotally supported such that its movement at the point of connection with the drive spring is predominantly in the direction of the working length of the drive spring to rapidly decrease the length of the drive spring and therefore decrease the force of the spring and the energy stored therein. Accordingly, contact pressure applied by the drive spring is quickly reduced whereby other forces associated with high currents overcome the reducing contact pressure and operate to open the contacts in advance of the movement of the line of action of the drive spring across the plane of the movable contact. A bimetal element operable on the latching system to release the latch lever is afforded increased displacement at its free end in response to overload currents by means of a high resistance terminal which supports the bimetal and concentrates heat and resulting deflection in the bimetal near the supported end. The terminal also has an extension projecting toward the contact separation area within the breaker and adjacent an arc extinguishing structure therein for attracting current present in the arc directly to the extension, thereby temporarily bypassing the bimetal and protecting it against high current damage. A more complete understanding of the invention will be had from the following description and claims when read in conjunction with the drawings.

DESCRIPTION OF THE PREFERRED EMBODIMENTS

Figure 1:
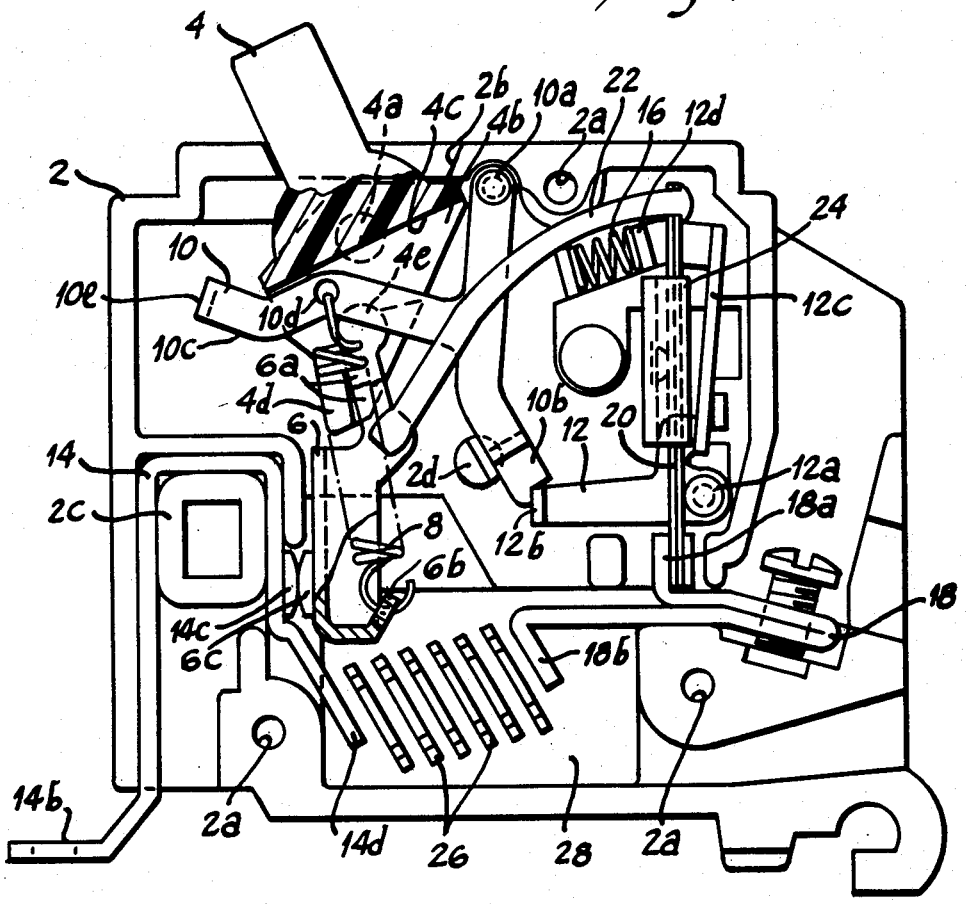
FIG. 1 is a side elevational view of the circuit breaker of this invention with a molded cover removed and showing the mechanism in the "on" condition.
Figure 2:
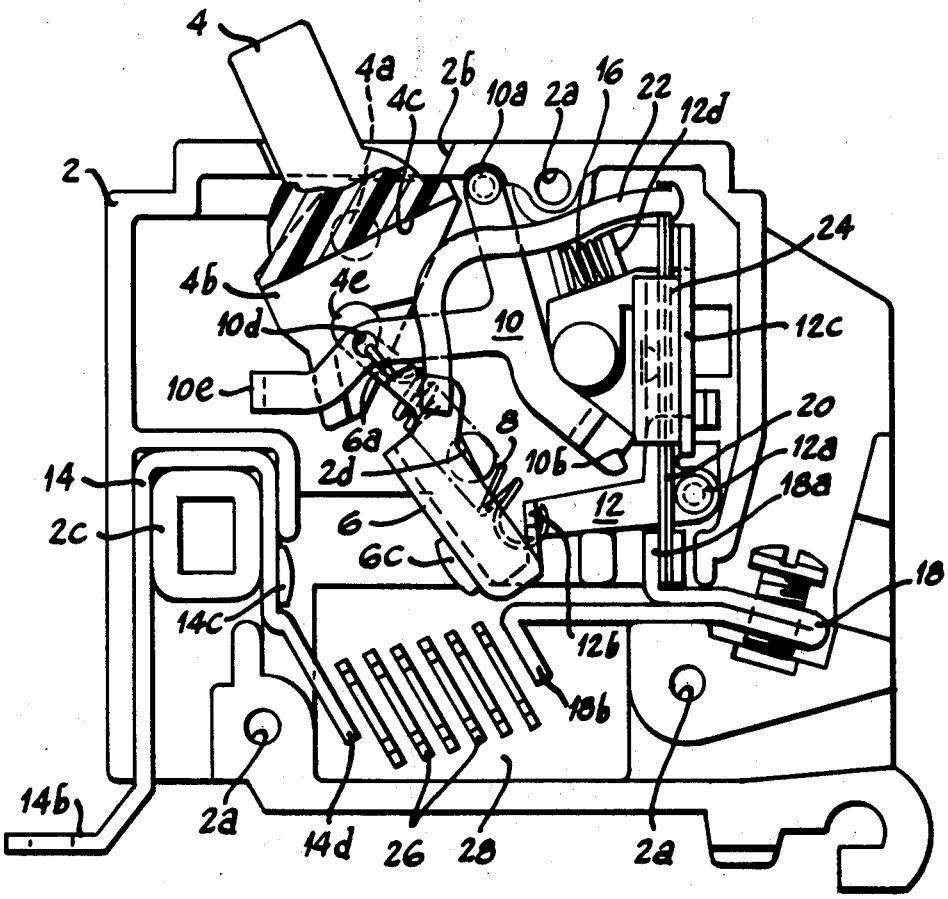
FIG. 2 is a view similar to FIG. 1 but showing the mechanism in a "tripped" position.

Referring to the drawings, the circuit breaker may be seen to comprise a molded housing 2 which has a shallow cavity therein configured to receive and position the operating mechanism of the circuit breaker. The mechanism is contained within this cavity by a molded cover (not shown) having a corresponding profile to the housing 2 and similarly configured to position the mechanism. This cover is secured to housing 2 by a plurality of fasteners (not shown) which extend through holes 2*a* in housing 2 and corresponding holes in the cover. The forward or upper wall of housing 2 has an opening 2*b* for receiving an operating handle 4 of the breaker. Operating handle 4 is journalled for pivotal movement by a pair of laterally extending trunions 4a (only one of which is shown in the drawings) which are received within suitable recesses in the housing and cover. The lower portion of operator handle 4 is provided with front and rear flanges 4b along its lateral edges defining a tunnel 4c therebetween, the front flange 4b being broken away for clarity in the drawing. A depending rib 4d is provided on the rear flange 4b as viewed in the drawings to provide a resetting function for the circuit breaker as will be described more fully later. The handle 4 also has ledges formed on the inner surfaces of flanges 4b, which ledges are provided with semi-circular recess segments 4e to pivotally locate one end of a movable contact arm 6. Movable contact arm 6 is formed of a good conducting metal in the shape of a channel to provide a pair of spaced upstanding arms 6a which have circular configurations at their upper ends to be received within the segments 4e of the handle member. The lower, or free end of the movable contact arm 6 has a tab 6b offset to be disposed between the lateral legs of the channel shaped contact arm and has a opening therein for receiving one end of a helical drive spring 8. The opposite end of drive spring 8 is connected to one leg of a Y-shaped latch lever 10 which is held in a static position by a releasable latch member 12. A movable contact element 6c is affixed to the lower face of movable contact arm 6.

A stationary contact support member 14 is mounted in the lower left-hand corner of the housing 2. Stationary contact support 14 is essentially an inverted U-shaped member which is positioned within a groove created in the housing 2 by a rectangular boss 2c spaced from associated walls of the housing. The lower left-hand end of stationary contact support 14 extends angularly outward and away from the bottom or lower edge of the housing 2 and is provided with an opening therein to serve as one terminal for the circuit breaker. The right-hand or interior end of stationary contact support 14 has a stationary contact element 14c attached thereto and has an arc runner 14d depending angularly away from the contact element 14c.

As thus far described, the circuit breaker may be manually operated between contact open and closed positions in a known manner wherein the handle 4 may be pivotally moved from the left-hand position shown in FIG. 1 to an opposite position against the right-hand edge of the opening 2b in the housing 2. This handle movement carries the upper ends of movable contact arm 6 to the left, across the line of action of drive spring 8, thereby causing the drive spring to move the lower end of contact arm 6 and contact element 6c away from stationary contact element 14c and against a stop 2d molded in the cavity of housing 2. Movement of the operating handle 4 back to the left-hand position shown in FIG. 1 carries the upper end of movable contact arm 6 back across the line of action of drive spring 8 to cause the latter to move the movable contact arm 6 and contact element 6c back into engagement with stationary contact element 14c as shown in the drawings. While the manual "off" or contact open position has not been specifically illustrated in the drawings, the operation thereof is well known in the circuit breaker art and reference may be had to the aforementioned M. F. Koenig et al patent for a more detailed description of this operation.

The latch lever 10 has a rivet 10a secured to the upper end of a main leg, the barrel of rivet 10a extending into a cylindrical recess formed in the housing 2 to function as a pivotal support for the latch lever. The lower end of that leg is offset toward the rear wall of the housing and has a latch surface 10b formed thereon. A second leg 10c extends obliquely from the main leg of latch lever 10 intermediate the ends thereof. Leg 10c has a hole 10d in which the upper end of drive spring 8 is attached and has an offset outer portion 10e which is formed over to extend laterally toward the rear wall of the housing 2. Leg 10c is disposed within the tunnel 4c of handle 4.

The latch arm 12 is pivotally supported in housing 2 by a rivet 12a which extends through the latch arm, the barrel of which is received within a cooperating cylindrical recess formed within the housing 2. The left-hand end of the latch arm 12 has a latching surface 12b offset to extend laterally forwardly within the housing 2 and engages the latch surface 10b of latch lever 10. Latch arm 12 has a upwardly extending leg 12c formed at substantially a right angle to the latch arm 12 which serves as an armature for a magnetic trip assembly. The upper end of leg 12c has a U-shaped hook portion 12d which is offset laterally to the rear and left within the housing cavity. A helical compression spring 16 is disposed between a projection in the housing 2 and the hook portion 12d to provide a clockwise bias to the latch arm 12 about the pivotal support 12a. A terminal member 18 is mounted within the housing 2 and the cover by suitable formations (not shown). Terminal 18 has an upstanding tab 18a to which one end of a bimetal strip 20 is affixed by welding, brazing or the like. The upper or free end of bimetal strip 20 is connected to the movable contact arm 6 by a flexible braided conductor 22. The upper end of bimetal strip is disposed within the U-shaped hook portion 12d of the latch arm 12. Intermediate its ends, bimetal 20 has a U-shaped pole piece 24 affixed thereto which is open toward the leg 12c of latch arm 12. Bimetal 20 serves as a single turn winding for the pole piece 24 whereupon a predetermined amount of current passing through the bimetal will induce a magnetic flux within the pole piece to attract the armature 12c thereto against the bias of spring 16.

When the circuit breaker terminals 14b and 18 are connected in circuit with an AC supply source and a branch circuit to be protected by the breaker, a current path is established in the breaker which consists of stationary contact support member 14b, stationary contact element 14c, movable contact element 6c, movable contact arm 6, flexible conductor 22, bimetal 20 and high resistance terminal 18. In the event that a low overload current exists in the circuit, the current will generate heat within the bimetal 20 and in the high resistance terminal 18. The high resistance of terminal 18 concentrates a higher amount of heat at the lower end of bimetal 20 adjacent its support than throughout the length of the bimetal. When heated, the bimetal will deflect to the left as viewed in the drawings to engage hook portion 12d at its upper end and drive the latch arm counterclockwise, thereby disengaging the latching surfaces 10b and 12b. The concentration of heat at the supported end of bimetal 20 causes more deflection at the fixed end than throughout the length of the bimetal. It will be appreciated that a small angular deflection at the fixed end of the bimetal translates to a large amount of displacement at the free end thereof. Accordingly, a significantly greater amount of free end movement of the bimetal is achieved under this construction without utilizing a more sensitive bimetal element. In the event that a higher magnitude overload current exists in the breaker, the current in bimetal 20 will generate the aforementioned magnetic field within the pole piece 24 and will rapidly attract the armature portion 12*c* of latch arm 12 thereto which also results in a counterclockwise movement of the latch arm 12 and a release of the latching surfaces 12*b* and 10*b*.

When the latch lever 10 is released by the aforedescribed counterclockwise movement of latch arm 12, it pivots about support 10*a* in a counterclockwise direction under the influence of drive spring 8 which is connected in tension between the arm 10*c* and the movable contact arm 6. The location of pivotal support 10*a* causes the arm 10*c* to swing downward predominantly in the direction of the working length or line of action of drive spring 8, thereby causing a rapid decrease in the length of spring 8 and quickly reducing the energy stored in spring 8 as a result of such reduction in length. As the point of connection of spring 8 in the opening 10*d* of the latch arm crosses the plane of the movable contact arm 6, which extends through the pivot for that contact arm, the drive spring 8 causes the movable contact arm 6 to pivot away from the stationary contact element 14*c* and into engagement with the aforementioned stop 2*d*. The greater component of movement of the point of connection of spring 8 in the hole 10*d* is in the direction of the line of action of the drive spring 8, while a smaller component of movement of that point of connection is in the direction toward the plane of movable contact arm 6 to carry the connection of spring 8 overcenter of the plane of movable contact arm 6. For overload currents of a low magnitude such as might cause tripping of the breaker by virtue of the bimetal element, the separation of the contacts is sufficiently rapid to adequately break the circuit. As the magnitude of the overload currents increases, such as to cause magnetic tripping, the overload currents generate other forces which assist the movable contact in separating from the stationary contact. For example, it is known that abutting contact elements actually engage in only a few point contact spots as opposed to a large area surface engagement. Thus the current which flows from one contact element to another is constricted to flow through such spots and this constriction generates repelling forces between the contacts. Moreover, the stationary contact support 14 is arranged to extend closely parallel to the movable contact arm 6 above the contact elements 14*c* and 6*c* and the current paths in these members are arranged in opposite directions such that repelling electromagnetic forces are established, which increase as the overload current increases. Accordingly, as the constriction and repulsion forces build up as a result of a high overload current, they overcome the contact pressure provided by the drive spring 8 and cause the movable contact member to separate from the stationary contact member in advance of the time at which the point of connection of the drive spring and latch lever cross the plane of the movable contact arm. By pivoting the latch lever 10 such that the predominant motion thereof upon trip release is in the direction of the line of action of drive spring 8, the force of drive spring 8 and the contact pressure provided thereby is quickly reduced whereby the constriction and repulsion forces may overcome the contact pressure earlier in the travel of the latch lever 10, thereby establishing earlier separation of the contacts.

An arc extinguishing structure is provided along the path of the movable contact element 6*c*. The arc extinguishing structure comprises a plurality of U-shaped metal arc splitter plates 26 mounted within a pair of spaced insulating plates 28 (only one of which is shown) which are positioned within suitable configurations in the housing and cover. The plates 26 are positioned angularly parallel to the arc runner 14*d* and are equally spaced from the arc runner and each other along the entire path. An extension 18*b* of terminal 18 projects inwardly from the terminal and is formed over to be parallel to the right-hand end plate 26 and spaced therefrom an amount equal to the spacing between the respective plates 26. Upon high overload current contact separation, an arc is established between the contacts and is driven into the arc plates 26 to be fragmentized and extinguished in a known manner. However, prior to complete extinguishing of the arc, current is present in the arc and the extension 18*b* of the terminal 18 serves as a bypass connection for this current around the bimetal member 20, thereby protecting it against a damaging "set" which might occur if a very high current pulse was received therein.

While the circuit breaker disclosed herein represents a preferred embodiment of the invention, it is to be understood that it is susceptible of various modifications without departing from the scope of the appended claims.

We claim:

1. In a circuit breaker of the type wherein pivotally supported movable contact means are driven into and out of engagement with stationary contact means by an overcenter drive spring in response to operator movement which carries the pivot of said movable contact means back and forth across the line of action of said drive spring, said drive spring being connected in tension between said movable contact means and a pivotally supported latch lever latched by overcurrent responsive latch means, said latch means being operable when said movable and stationary contact means are in engagement to release said latch lever for pivotal movement under the influence of said drive spring whereby said latch lever carries the line of action of said drive spring across the pivot of said movable contact means to effect separation of said movable and stationary contact means, the improvement comprising, in combination:

arranging said stationary and movable contact means for providing spaced parallel reversely directed current paths therein when said movable and stationary contacts are in engagement whereby fault currents establish opposing magnetic forces in said movable and stationary contact means tending to drive said movable contact means away from said stationary contact means; and positioning the pivotal support of said latch lever with respect to the connection of said drive spring to said latch lever such that movement of said connection when said latch lever is released provides a greater component of movement at said connection in the direction of the line of action of said drive spring than the corresponding component of movement normal to said line of action for rapidly reducing the energy stored in said spring below the magnetic force established by said fault currents to effect separation of said contact means by said magnetic force before said latch lever carries the line of action of said drive spring across the pivot of said movable contact means.

2. The invention defined in claim 1 wherein said pivotal support for said latch lever and said drive spring are positioned on opposite sides of a plane extending through said connection perpendicularly to said line of action of said drive spring.

3. The invention defined in claim 2 wherein said pivotal support for said latch lever is positioned above a plane extending through said connection perpendicular to said line of action of said drive spring.

4. A circuit breaker comprising, in combination:

a pivotally supported operator;

stationary contact means;

movable contact means pivotally supported on said operator and movable for engagement with said stationary contact means;

said stationary contact means and said movable contact means being arranged for providing spaced parallel reversely directed current paths therein when said movable and stationary contacts are in engagement whereby fault currents therein establish opposing magnetic forces in said stationary and movable contact means tending to drive said movable contact means away from said stationary contact means;

a pivotally supported latch lever;

an overcenter drive spring for said movable contact means connected in tension between said movable contact means and said latch lever;

overcurrent responsive releasable latch means latching said latch lever wherein the connection between said spring and said latch lever is static and said operator is movable in opposite directions to carry the pivotal support of said movable contact means across a line of action of said spring to drive said movable contact means into and out of engagement with said stationary contact means;

said latch means being operable in response to overload currents to release said latch lever for pivotal movement under the influence of said drive spring wherein said latch lever carries said connection between said latch lever and said spring across the line of action of said spring to drive said movable contact means out of engagement with said stationary contact means; and wherein the pivotal support for said latch lever is positioned to effect greater movement of said connection in the direction of the line of action of said drive spring than in a lateral direction normal to said line of action when said latch lever is released for rapidly reducing energy stored in said drive spring below the magnetic force established by fault currents in said stationary and movable contact means to effect separation of said movable contact means from said stationary contact means by said magnetic force before said latch lever carries the line of action of said drive spring across the pivot of said movable contact means.

5. The invention defined in claim 4 wherein said pivotal support for said latch lever is positioned on the opposite side of said movable contact means from said stationary contact.

6. The invention defined in claim 4 wherein said pivotal support for said latch lever and said drive spring are positioned on opposite sides of a plane extending through said connection perpendicularly to said line of action of said drive spring.

7. The invention defined in claim 6 wherein said pivotal support for said latch lever is positioned above a plane extending through said connection perpendicular to said line of action of said drive spring.

8. The invention defined in claim 4 wherein said overcurrent responsive releasable latch means comprises:

a conductor connected in series circuit with said movable contact means and said stationary contact means;

a magnetic pole piece supported on said conductor;

a pivotally supported latch member having an armature extending in a first direction from the pivot of said latch member and attractable to said pole piece and a latch arm extending in a second direction from the pivot of said latch member and engageable with said latch lever; and means biasing said latch member armature away from said pole piece and said latch arm into engagement with said latch lever;

wherein said armature is attracted to said pole piece in response to overcurrents in said conductor to pivot said latch arm away from said latch lever, thereby to release said latch lever.

9. The invention defined in claim 8 wherein said conductor comprises a bimetal member operable upon overcurrents to deflect away from said armature, and means on said armature engagable by said bimetal for pivoting said latch arm away from said latch lever thereby to release said latch lever.

10. The invention defined in claim 9 wherein said latch member is arranged for movement of said armature in response to overcurrents in a direction toward said latch lever.

11. The invention defined in claim 4 further comprising:

arc extinguishing means adjacent said stationary contact means and disposed along the path of said movable contact means;

means electrically connecting said movable contact means and said overcurrent responsive latch means;

terminal means electrically connected to said overcurrent responsive latch means for connection of one side of said circuit breaker to an external circuit, said terminal means having an extension projecting toward said arc extinguishing means; and wherein an arc established upon separation of said movable contact means from said stationary contact means is drawn into said arc extinguishing means and said extension and current present in said arc bypasses said overcurrent responsive latch means to protect the latter.

12. The invention defined in claim 11 wherein said overcurrent responsive releasable latch means comprises a bimetal strip mounted at one end on said terminal, means and said means electrically connecting said movable contact means and said overcurrent responsive latch means is connected at the other end of said bimetal.

13. The invention defined in claim 12 wherein said terminal means comprises a high resistance material for generating increased temperature in said bimetal at said one end.

* * * * *